US006824965B2

(12) United States Patent
Wichmann et al.

(10) Patent No.: US 6,824,965 B2
(45) Date of Patent: Nov. 30, 2004

(54) BLEACH BATH

(75) Inventors: Ralf Wichmann, Bergisch Gladbach (DE); Thomas Hübsch, Köln (DE); Thomas Stetzer, Langenfeld (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/919,678

(22) Filed: Aug. 1, 2001

(65) Prior Publication Data

US 2002/0037482 A1 Mar. 28, 2002

(30) Foreign Application Priority Data

Aug. 4, 2000 (DE) ..... 100 38 018

(51) Int. Cl.[7] ..... G03C 7/42
(52) U.S. Cl. ..... 430/393; 430/430
(58) Field of Search ..... 430/393, 460, 430/461, 430

(56) References Cited

U.S. PATENT DOCUMENTS

| | | | | | |
|---|---|---|---|---|---|
| 3,241,966 | A | | 3/1966 | Heilmann et al. | 430/393 |
| 3,589,501 | A | * | 6/1971 | Harrison | 198/370.04 |
| 3,615,508 | A | | 10/1971 | Stephen et al. | 430/393 |
| 4,184,876 | A | | 1/1980 | Eeles et al. | 430/505 |
| 4,921,779 | A | | 5/1990 | Cullinan et al. | 430/393 |
| 4,933,266 | A | | 6/1990 | Stephen et al. | 430/393 |
| 4,939,075 | A | | 7/1990 | Bergthaller et al. | 430/460 |
| 4,975,356 | A | | 12/1990 | Cullinan et al. | 430/393 |
| 5,037,725 | A | | 8/1991 | Cullinan et al. | 430/372 |
| 5,238,791 | A | | 8/1993 | Tappe et al. | 430/393 |
| 5,453,348 | A | | 9/1995 | Kuse et al. | 430/385 |
| 5,523,195 | A | | 6/1996 | Darmon et al. | 430/393 |
| 5,552,264 | A | | 9/1996 | Cullinan et al. | 430/372 |
| 5,580,705 | A | * | 12/1996 | Ueda et al. | 430/393 |
| 5,635,341 | A | * | 6/1997 | Yamashita et al. | 430/380 |
| 5,652,087 | A | * | 7/1997 | Craver et al. | 430/430 |
| 5,658,715 | A | * | 8/1997 | Nakamura et al. | 430/379 |
| 5,736,302 | A | | 4/1998 | Buongiorne et al. | 430/379 |
| 5,885,757 | A | | 3/1999 | Inaba et al. | 430/430 |
| 6,013,422 | A | * | 1/2000 | Price | 430/393 |
| 6,017,689 | A | | 1/2000 | Bell et al. | 430/504 |
| 6,022,674 | A | * | 2/2000 | McGuckin et al. | 430/372 |
| 6,048,673 | A | | 4/2000 | Kuramitsu et al. | 430/362 |
| 6,346,368 | B1 | * | 2/2002 | Irie | 430/379 |
| 6,365,332 | B1 | * | 4/2002 | Price et al. | 430/461 |

FOREIGN PATENT DOCUMENTS

| | | |
|---|---|---|
| DE | 25 30 645 | 1/1976 |
| DE | 2 321 400 | 11/1979 |
| DE | 3 743 783 | 7/1989 |
| DE | 3 800 270 | 7/1989 |
| DE | 40 29 805 | 3/1992 |
| DE | 19 742 040 | 1/2000 |
| EP | 329 086 | 8/1989 |
| EP | 468 325 | 1/1992 |
| GB | 1 392 163 | 4/1975 |

OTHER PUBLICATIONS

Research Disclosure, "Photographic Bleaching and Bleach–Fixing Composition", vol. 240, item 24023, (Apr. 1984) p. 156.

Research Disclosure, "Typical and Preferred Color Paper, Color Negative, and Color Recersal Photographic Elements and Processing", item 37038, pp. 79, 102–114, (1995).

Research Disclosure, "Farbfotografische Materialien" item 37254 (Apr. 1995) pp. 294–295 (relevant portion in English).

Handbook "Agfachrome Process 63" Technical Data, 9$^{th}$ Edition (Aug., 2000).

Handbook "Agfachrome Process 44" Technical Data, 14$^{th}$ Edition (Jan., 2001).

Kodak Publication Z–119 (in part), "Kodak Chemicals, Process E–6" "Processing Solutions and Their Effects" published prior to Aug. 4, 2000.

Kodak Publication Z–129 (in part), "Kodak EKTACHROME R–3 and R–3000 Chemicals", "Process Monitoring" (1997).

* cited by examiner

*Primary Examiner*—Hoa Van Le
(74) *Attorney, Agent, or Firm*—Connolly Bove Lodge & Hutz LLP

(57) ABSTRACT

A bleach or bleach/fixing solution for processing photographic silver halide materials which, relative to the silver halide content of the unprocessed material, exhibit prior to the bleaching step a content of silver arising from development of at least 65 mol %, in particular for processing color reversal materials, characterized in that the solution contains at least one iron complex of propylenediaminetetraacetic acid or of β-alaninediacetic acid or a mixture of these complexes and the total concentration of the stated iron complexes in the solution is at least 0.045 and at most 0.25 mol/l and a process for processing, in which such a solution is used, is characterized by a small introduced quantity of iron complexes, a low residual silver content, a low bleaching fog value, elevated resistance to precipitation and in that the bleach solution may be rejuvenated.

18 Claims, No Drawings

BLEACH BATH

This invention relates to a bleach or bleach/fixing solution for processing photographic silver halide materials which, relative to the silver halide content of the unprocessed material, exhibit prior to the bleaching step a content of silver arising from development of at least 65 mol %, in particular to a bleach or bleach/fixing solution for processing colour reversal materials and to a process for the processing colour reversal materials using such a solution.

It is known to use iron(III) complexes of aminopolycarboxylic acids for bleaching photographic materials, i.e. for oxidising the metallic silver formed during development, for which purpose numerous complexing agents have been proposed (c.f. for example Research Discl., Vol. 240, Item 24023, DE 2 321 400, DE 3 743 783, DE 3 800 270, U.S. Pat. Nos. 3,241,966, 3,615,508, 5,238,791, 5,885,757). In practice, colour reversal materials are usually processed using the iron(III) complex with ethylenediaminetetraacetic acid (EDTA) at a concentration of at least 0.30 mol/l as the complexing agent for bleach baths. While other substances, such as for example propylenediaminetetraacetic acid (PDTA), β-alaninediacetic acid (ADA), methyliminodiacetic acid (MIDA), diethylenetriaminepentaacetic acid (DTPA), iminosuccinic acid propionate (ISP), racemic and (S,S)-ethylenediaminedisuccinic acid (EDDS), are indeed stated as suitable iron(III) complexing agents for bleaching photographic materials and have successfully been used for processing colour negative materials, suitability for the specific requirements of colour reversal processing has not been described.

The content of complexing agents is excessively high in known bleach baths for colour reversal materials. Apart from entailing material costs, this content is in particular associated with an unwanted environmental impact as the complexing agents used are sparingly biodegradable. The elevated concentration is used in order to meet the very stringent requirements which reversal materials place on a bleaching bath. In reversal processing, the majority of the silver halide is in fact reduced to silver, namely in the first development initially the proportion of crystals exposed with the image, which generally amounts to less than 30 mol %, and then the unexposed crystals on secondary development after the reversal bath, such that, relative to the total silver content of the material, at least 65 mol % of $Ag^0$, frequently at least 80 mol % and often even at least 90 mol % of $Ag^0$ must be bleached, whereas in negative materials this proportion of $Ag^0$ originates only from the exposed crystals and is accordingly conventionally distinctly below 30 mol %. This difference with colour reversal films is manifested particularly seriously in materials having a total silver content, stated as silver nitrate, of at least 6.0 g/m$^2$, in particular of at least 7.5 g/m$^2$. Unless indicated to the contrary, all absolute quantities of silver are stated hereinafter as g of silver nitrate; 1 mol of silver is accordingly stated as 170 g of silver, irrespective of whether it is metallic or chemically bound silver.

When processing colour reversal films, at least 3.9 g of silver, frequently at least 5.6 g of silver and often even at least 6.3 g of silver must be bleached per m$^2$.

Another problem of known bleach baths is the stability of the bath with regard to chemical precipitation. U.S. Pat. No. 4,933,266 accordingly discloses that when an iron/PDTA bleaching bath is used, it is necessary to use another complexing agent, such as for example diaminopropanoltetraacetic acid (DPTA) in order to counteract precipitation, for example due to entrained phosphate. Such additional complexing agents constitute an additional chemical load in the bleach baths and are accordingly unwanted both on cost grounds and due to the associated environmental impact.

Moreover, it is not possible according to the prior art simultaneously to achieve in colour reversal processing both a very good bleaching action, discernible from a very low residual silver content, and a very low bleaching fog value, discernible from a low value of yellow minimum density. Both requirements are particularly critical in reversal materials since, on the one hand, as described above, an elevated proportion of reduced silver must be bleached and, on the other, both the residual silver, which is usually coloured, and the bleaching fog give rise to colour casts and an elevated minimum density, which have a severely disruptive effect for example when projecting reversal films and, unlike with negative films, cannot be corrected by the enlargement process in the printer.

Known bleach baths for reversal materials exhibit further environmental and economic disadvantages as they cannot sensibly be reprocessed. Due to the required elevated active substance content, such a large volume of fresh concentrate would have to be added to the used solution that the resultant increase in volume would make recycling uneconomic. The increase in volume also results in increased quantities of waste.

The object underlying the invention is accordingly to provide a bleach or bleach/-fixing bath which is particularly suitable for processing photographic silver halide materials having an elevated proportion of silver to be bleached and in particular is suitable for processing colour reversal materials, and to provide a process for processing colour reversal materials, wherein the least possible quantity of complexing agent should be used, a low residual silver content and simultaneously a low bleaching fog value of the processed materials should be achieved and the bleach or bleach/fixing bath should also be resistant to precipitation without stabilising additives.

It has now surprisingly been found that this may be achieved if the iron/PDTA or iron/ADA complex is used in the ready-to-use bleach or bleach/fixing bath in a concentration range of from 0.045 to 0.25 mol/l. Particularly surprisingly it is consequently possible to manage with only little bleaching agent, despite the elevated proportion of silver to be bleached.

The present invention accordingly provides a bleach or bleach/fixing solution for processing photographic silver halide materials which, relative to the silver halide content of the unprocessed material, exhibit prior to the bleaching step a content of silver arising from development (bleaching proportion) of at least 65 mol %, characterised in that the solution contains at least one iron complex of propylenediaminetetraacetic acid or of β-alaninediacetic acid or a mixture of these complexes and the total concentration of the stated iron complexes in the solution is at least 0.045 and at most 0.25 mol/l.

The iron complex of PDTA is conventionally used as a sodium, potassium or ammonium salt, but any other cations may also be used.

In a preferred embodiment, the bleach bath used contains no ammonium ions.

The bleaching proportion may readily be determined by, contrary to conventional practice, only fixing the developed material and then determining the silver content, for example by using the X-ray fluorescence method. This value is then related to the corresponding result for the unprocessed material.

The present invention also provides a bleach or bleach/fixing solution for processing colour reversal silver halide materials, characterised in that the solution contains at least one iron complex of propylenediaminetetraacetic acid or of β-alaninediacetic acid or a mixture of these complexes and the total concentration of the stated iron complexes in the solution is at least 0.045 and at most 0.25 mol/l.

The bleach baths according to the invention are advantageously used for materials having a bleaching proportion of at least 80 mol %, in particular of at least 90 mol %.

The bleach baths according to the invention are preferably used for materials with negative-working emulsions. These may, in rare cases, comprise special negative materials in which an unusually large proportion of the silver halide crystals is exposed and thus reduced to silver even at the first development stage. Usually, however, the materials are reversal materials and in particular colour reversal materials which, after the first development, pass through a reversal step and a second development (reversal development). Particularly advantageous bleaching fog value values are achieved in colour reversal materials with chromogenic reversal development.

The bleach baths according to the invention are advantageously used for materials having a total quantity of silver of at least 6 g/m$^2$, in particular of at least 7.5 g/m$^2$, wherein the materials particularly advantageously comprise film materials with a transparent support.

The bleach baths according to the invention are preferably used for materials in which at least 3.9 g of silver, in particular at least 5.6 g of silver and particularly preferably at least 6.3 g of silver must be bleached during the processing thereof.

The concentration range according to the invention of PDTA or ADA iron complexes of 0.045 to 0.25 mol/l relates to the ready-to-use solution or the tank solution which is in use. In contrast, for storage and distribution purposes, it is usually more advantageous to supply the necessary chemicals in a preparation usually having a lower or even zero water content, wherein the chemicals may comprise one or more components from which the ready-to-use solutions are only subsequently prepared, usually directly by the end-user, conventionally by addition of water. Such preparations preferably having a lower water content are not only suitable for preparing fresh bleach solutions, but are also suitable to be added for the purpose of regenerating used baths in the processing facility and for refreshing the overflow in order to permit reuse thereof.

For the purposes of the invention, components should be taken to mean any separately supplied containers such as solutions, liquids or solids or formulations thereof, such as tablets or capsules.

Reuse of the overflow after refreshing or rejuvenation is particularly preferred because much less of the solution, which is difficult to dispose of, is formed as a consequence. It has been found that the bleach baths according to the invention are very well suited to rejuvenation and that, even under these conditions which may result in a build up of disruptive substances, such as phosphate for example, entrained with the material or rinsing water, no precipitation occurs. The bleach solutions according to the invention may particularly effectively be rejuvenated if the content thereof in the tank solution is between 0.045 and 0.20 mol/l.

One-part concentrates are in particular preferred as preparations having a lower water content.

Although, according to the invention, the bleaching baths may comprise both bleach baths and combined bleach/fixing baths, it is preferred to use bleach baths which have substantially no fixing action, in particular if a very low bleaching fog value is to be achieved. The bleach baths advantageously contain thiosulfate at most in a quantity which is insufficient to fix the undeveloped silver halide; the baths particularly advantageously contain substantially no thiosulfate.

Whenever the bleach solutions according to the invention are used, lower susceptibility to disruptive precipitation and a lower bleaching fog are always achieved, but PDTA and ADA behave somewhat differently. If particularly elevated resistance to precipitation is to be achieved, it is preferred to use an elevated proportion of or substantially only PDTA as the complexing agent. If, instead, the aim is to achieve the lowest possible bleaching fog value, it is preferred to use an elevated proportion of or substantially only ADA as the complexing agent. "Elevated proportion" is intended to mean at least 60, in particular at least 80 and particularly advantageously at least 90 mol %, relative to the complexing agents.

Apart from Fe/PDTA and/or Fe/ADA, the bleach solutions according to the invention may also contain further iron complexes, including those with other aminopolycarboxylic acids as ligands, for example Fe/EDTA or Fe/DTPA. In this case, the total concentration of iron complexes should, however, be no more than 0.25 mol/l.

The bleach solutions particularly preferably contain substantially no iron/aminopolycarboxylic acid component other than Fe/PDTA or Fe/ADA.

The bleach baths according to the invention may be used for any known processing processes, provided that these processes are suitable for colour reversal materials or materials in which at least 65 mol % of the total silver must be bleached.

The basic processing steps for reversal materials and the constituents used are described inter alia in Res. Discl. 37038 (1995), pages 109–114 and Res. Discl. 37254 (1995), pages 294 et seq. More detailed examples of reversal materials and reversal development, for which the bleach baths according to the invention are suitable may be found inter alia in DE 19 742 040 and U.S. Pat. Nos. 6,048,673, 6,013,422, 4,921,779, 4,975,356, 5,037,725, 5,523,195, 5,552,264, 5,736,302, Agfa AP 44 and AP 63 process manuals, and in "Process E-6 Using KODAK Chemicals, Process E-6 Publication Z-119" and "Process R-3 Using KODAK EKTACHROME R-3 Chemicals Publication Z-129", both published by Eastman Kodak.

A preferred process for processing colour reversal silver halide materials is one containing a bleaching step, characterised in that the bleaching step is performed using a solution which contains at least one iron complex of propylenediaminetetraacetic acid or of β-alaninediacetic acid or a mixture of these complexes and the total concentration of the stated iron complexes in the solution is at least 0.045 and at most 0.25 mol/l.

The process is particularly suitable for materials with a transparent support which preferably comprise at least 6.0 g of silver per m$^2$.

In one advantageous embodiment, prior to the bleaching step, the process comprises at least the steps first development, reversal step and colour development, wherein the reversal step may comprise chemical fogging (reversal bath) or exposure to light and colour development preferably proceeds chromogenically.

The bleaching step may include fixing, but it is preferred if the process comprises a separate fixing step after the bleaching step.

In one particularly preferred embodiment, the process according to the invention comprises the following process steps in the stated order:

first developer—water rinsing—reversal bath—colour developer—conditioning bath—bleach bath—(water rinsing)—fixing bath—water rinsing—finishing bath—drying.

The water rinsing steps, in particular the bracketed water rinsing between the bleach and fixing bath, may be omitted, especially if mechanical measures are implemented counteract bath entrainment. However, if the least possible bleach fog is to be achieved, it is preferred to retain the water rinsing steps, in particular those outside the brackets.

The water rinsing steps may also be replaced by intermediate rinsing and stabilising stages, such that the process may, for example, be performed in Minilabs, i.e. processing machines without a water supply.

The composition of the baths, conventional processing temperatures and times are exhaustively described in the above-stated references. Use of the baths according to the invention is, however, not restricted to these known ranges.

The conditioning bath may contain substantially no formalin or formalin releasers or may contain a formalin releaser and, in the latter case, is also known as a "pre-bleach".

It is preferred if the conditioning bath contains little thioglycerol, in particular if the concentration thereof is less than 1.0 vol. %. Surprisingly, very good bleaching action is achieved when the bleach solutions according to the invention are used, despite economising on thioglycerol. This even applies if thioglycerol is substantially completely dispensed with.

The finishing bath may also contain substantially no formalin or formalin releasers or may contain formalin.

It is advantageous if the process equilibrium of the bleach bath is maintained by addition of a regenerator. In particular, it is preferred if this is achieved by direct apportionment of a concentrated solution.

It is particularly advantageous if the process equilibrium of the solution used for the bleaching step is maintained by apportioning a solution obtained from the bath overflow after rejuvenation.

Further preferred embodiments of the invention are disclosed in the subordinate claims.

Examples of colour photographic materials are colour negative films, colour reversal films, colour positive films, colour photographic paper, colour reversal photographic paper, colour-sensitive materials for the dye diffusion transfer process or the silver dye bleaching process. A review may be found in Research Disclosure 37038 (1995) and Research Disclosure 38957 (1996).

The photographic materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627.

The colour photographic materials conventionally contain at least one red-sensitive, one green-sensitive and one blue-sensitive silver halide emulsion layer, optionally together with interlayers and protective layers.

Depending upon the type of photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sublayers are generally arranged closer to the support than the more highly sensitive sublayers.

A yellow filter layer is conventionally located between the green-sensitive and blue-sensitive layers which prevents blue light from penetrating into the underlying layers.

Possible options for different layer arrangements and the effects thereof on photographic properties are described in J. Inf. Rec. Mats., 1994, volume 22, pages 183–193 and in Research Disclosure 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in a photographic film in order to increase sensitivity (DE 25 30 645).

The substantial constituents of the photographic emulsion layers are binder, silver halide grains and colour couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Photographic materials with camera sensitivity conventionally contain silver bromide-iodide emulsions, which may optionally contain small proportions of silver chloride. Photographic print materials contain either silver chloride-bromide emulsions containing up to 80 mol % of AgBr or silver chloride-bromide emulsions containing above 95 mol % of AgCl.

Details of colour couplers may be found in Research Disclosure 37254, part 4 (1995), page 288, in Research Disclosure 37038, part II (1995), page 80 and in Research Disclosure 38957, part X.B (1996), page 616. The maximum absorption of the dyes formed from the couplers and the colour developer oxidation product is preferably within the following ranges: yellow coupler 430 to 460 nm, magenta coupler 540 to 560 nm, cyan coupler 630 to 700 run.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290, in Research Disclosure 37038, part XIV (1995), page 86 and in Research Disclosure 38957, part X.C (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 μm in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally arranged between layers of different spectral sensitivity may contain agents which prevent an undesirable diffusion of developer oxidation products from one photosensitive layer into another photo-sensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq.

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce colour fogging and to reduce yellowing, and others. Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, colour photographic materials are processed using different processes depending upon their nature. Details relating to processing methods and the necessary chemicals are disclosed in Research Disclosure 37254, part 10 (1995), page 294, in Research Disclosure 37038, parts XVI to XXII (1995), pages 95 et seq. and in Research Disclosure 38957, parts XVIII, XIX and XX (1996), pages 630 et seq. together with example materials.

EXAMPLES

| Process sequence | Time | Temperature |
|---|---|---|
| First developer | 6 min | 38° C. |
| Water rinsing | 2 min | 38° C. |
| Reversal bath | 2 min | 38° C. |
| Colour developer | 6 min | 38° C. |
| Conditioning bath without formalin or "pre-bleach" with formalin releaser | 2 min | 38° C. |
| Bleach bath | 6 min | 38° C. |
| Water rinsing (may also be omitted) | 2 min | 38° C. |
| Fixing bath | 4 min | 38° C. |
| Water rinsing | 4 min | 38° C. |
| Finishing bath with or without formalin | 1 min | 38° C. |
| Drying | max. 63° C. | |

Conventional commercial Agfa AP 44 chemicals were used; the "pre-bleach" with formalin releaser (as also described in U.S. Pat. No. 5,552,264) was of the following composition:

Pre-bleach

| | |
|---|---|
| Water | 600 ml |
| Sodium formaldehyde bisulfite addition compound | 25.0 g |
| Thioglycerol | 0.4 g |
| Potassium sulfite | 6.0 g |
| Phosphoric acid | 0.2 g |
| EDTA | 3.0 g |

Make up to 1 liter, adjust pH to 6.15 with KOH.

The bleach baths used were of the following composition:

| | |
|---|---|
| Water | 600 ml |
| Potassium bromide | 85.0 g |
| Hydrobromic acid | 33.0 ml |
| Iron(III) salt of a complexing agent according to Tables 1 to 3 | |
| free excess acid of the particular complexing agent according to Tables 1 to 3 | 0.015 mol |
| Potassium nitrate | 25.0 g |
| make up to 1 liter with water | |
| pH value (adjust with ammonia or hydrobromic acid) | 5.0 |

Reversal material M-1 was processed after being exposed with subjects typical of amateur photography. Substantially irrespective of the selected subject, after colour development and before the bleaching step, the material had a reduced silver content of greater than 90 mol %, corresponding to greater than 7.3 g of silver for bleaching.

Reversal Material M-1

The layers listed below were applied in succession onto a layer support of cellulose triacetate provided with an adhesion promoting layer.

| | |
|---|---|
| 1st layer (anti-halo layer) | |
| Black colloidal silver sol | |
| Silver application rate as silver nitrate | 0.40 g/m$^2$ |
| Gelatine | 1.60 g/m$^2$ |
| UV absorber UV | 0.24 g/m$^2$ |
| 2nd layer (interlayer) | |
| Gelatine | 0.64 g/m$^2$ |
| 3rd layer (first red-sensitive layer) | |
| Red-sensitised silver halide emulsion (avg. grain diameter 0.34 μm, 96 mol % bromide, 4 mol % iodide) | |
| Silver application rate as silver nitrate | 0.95 g/m$^2$ |
| Coupler C-1 | 0.24 g/m$^2$ |
| Gelatine | 0.80 g/m$^2$ |
| Tricresyl phosphate (TCP) | 0.12 g/m$^2$ |
| 4th layer (second red-sensitive layer) | |
| Red-sensitised silver halide emulsion (avg. grain diameter 0.43 μm, 97 mol % bromide, 3 mol % iodide) | |
| Silver application rate as silver nitrate | 2.00 g/m$^2$ |
| Coupler C-1 | 1.29 g/m$^2$ |
| Gelatine | 2.64 g/m$^2$ |
| TCP | 0.65 g/m$^2$ |
| 5th layer (interlayer) | |
| Gelatine | 1.78 g/m$^2$ |
| Compound S | 0.24 g/m$^2$ |
| TCP | 0.12 g/m$^2$ |

-continued

| | |
|---|---|
| 6th layer (first green-sensitive layer) | |
| Green-sensitised silver halide emulsion (avg. grain diameter 0.34 μm, 96 mol % bromide, 4 mol % iodide) | |
| Silver application rate as silver nitrate | 1.05 g/m$^2$ |
| Coupler C-3 | 0.22 g/m$^2$ |
| Gelatine | 1.00 g/m$^2$ |
| TCP | 0.22 g/m$^2$ |
| 7th layer (second green-sensitive layer) | |
| Green-sensitised silver halide emulsion (avg. grain diameter 0.42 μm, 98.5 mol % bromide, 1.5 mol % iodide) | |
| Silver application rate as silver nitrate | 1.65 g/m$^2$ |
| Coupler C-3 | 1.00 g/m$^2$ |
| Gelatine | 2.65 g/m$^2$ |
| TCP | 1.00 g/m$^2$ |
| 8th layer (interlayer) | |
| Gelatine | 0.70 g/m$^2$ |
| Compound S | 0.10 g/m$^2$ |
| TCP | 0.05 g/m$^2$ |
| 9th layer (yellow filter layer) | |
| Yellow colloidal silver sol | |
| Silver application rate as silver nitrate | 0.19 g/m$^2$ |
| Gelatine | 0.75 g/m$^2$ |
| 10th layer (interlayer) | |
| Gelatine | 0.50 g/m$^2$ |
| 11th layer (first blue-sensitive layer) | |
| Blue-sensitised silver halide emulsion (avg. grain diameter 0.52 μm, 95 mol % bromide, 5 mol % iodide) | |
| Silver application rate as silver nitrate | 0.60 g/m$^2$ |
| Coupler C-2 | 0.60 g/m$^2$ |
| Gelatine | 0.90 g/m$^2$ |
| TCP | 0.30 g/m$^2$ |
| 12th layer (second blue-sensitive layer) | |
| Blue-sensitised silver halide emulsion (avg. grain diameter 0.70 μm, 95 mol % bromide, 5 mol % iodide) | |
| Silver application rate as silver nitrate | 0.90 g/m$^2$ |
| Coupler C-2 | 0.90 g/m$^2$ |
| Gelatine | 1.00 g/m$^2$ |
| TCP | 0.45 g/m$^2$ |
| 13th layer (interlayer) | |
| Compound S | 0.50 g/m$^2$ |
| Gelatine | 2.56 g/m$^2$ |
| TCP | 0.02 g/m$^2$ |
| UV absorber UV | 0.55 g/m$^2$ |
| 14th layer (interlayer) | |
| Lippmann silver halide emulsion (avg. grain diameter 0.15 μm, 96 mol % bromide, 4 mol % iodide) | |
| Silver application rate as silver nitrate | 0.33 g/m$^2$ |
| Gelatine | 0.60 g/m$^2$ |
| 15th layer (protective layer) | |
| Hardener H | 1.20 g/m$^2$ |
| Gelatine | 0.80 g/m$^2$ |

The components used are of the following formulae:

C-1

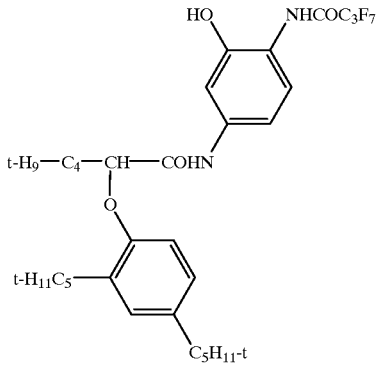

C-2

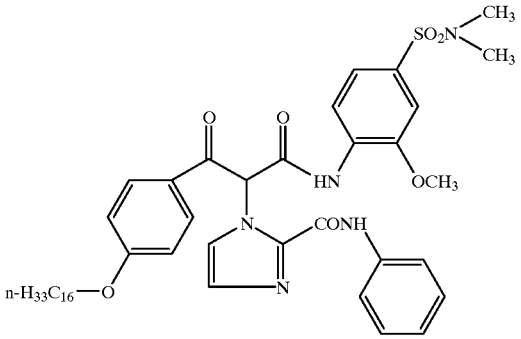

C-3

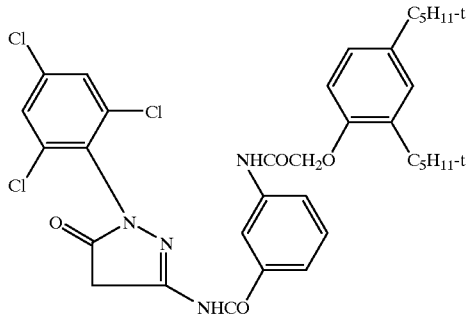

H

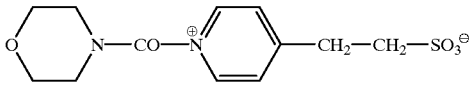

S

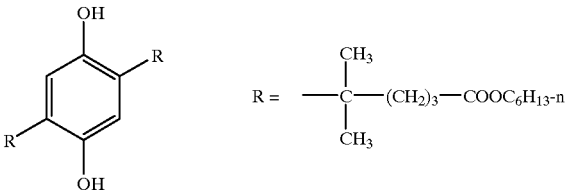

-continued

UV

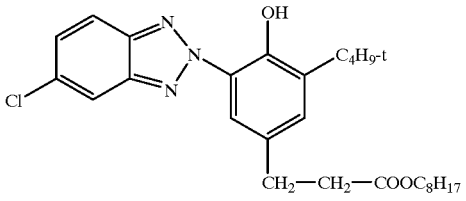

Example 1

Exposed reversal material M-1 was processed in accordance with the above-stated process sequence, wherein the bleaching complexes and concentrations stated in Table 1 were used in the bleach bath. The residual silver remaining in the material was determined by X-ray fluorescence by post-development of resultant bleaching fog, measuring Δ Dmin yellow and calculating the difference from true-to-type processing (1st Example in Table 1).

TABLE 1

| Complexing agent | Iron complex concentration [mol/l] | Bleaching time [min] | Residual silver [g/m$^2$] | Δ Dmin yellow | |
|---|---|---|---|---|---|
| EDTA | 0.34 | 6 | 0.034 | 0.00 | Comparison |
| EDTA | 0.20 | 6 | 1.153 | 0.01 | Comparison |
| EDTA | 0.20 | 12 | 0.057 | 0.01 | Comparison |
| MIDA | 0.34 | 6 | 0.192 | 0.46 | Comparison |
| MIDA | 0.20 | 6 | 0.973 | 0.25 | Comparison |
| PDTA | 0.34 | 6 | 0.026 | 0.58 | Comparison |
| PDTA | 0.28 | 6 | 0.029 | 0.49 | Comparison |
| PDTA | 0.20 | 6 | 0.029 | 0.01 | Invention |
| PDTA | 0.09 | 6 | 0.031 | 0.01 | Invention |
| PDTA | 0.09 | 8 | 0.029 | 0.01 | Invention |
| PDTA | 0.045 | 6 | 0.032 | 0.01 | Invention |
| PDTA | 0.035 | 6 | 0.199 | 0.01 | Comparison |
| PDTA | 0.035 | 12 | 0.141 | 0.01 | Comparison |
| ADA | 0.34 | 6 | 0.028 | 0.51 | Comparison |
| ADA | 0.25 | 6 | 0.027 | 0.45 | Comparison |
| ADA/PDTA | 0.20/0.02 | 6 | 0.027 | 0.01 | Invention |
| ADA | 0.09 | 6 | 0.032 | 0.01 | Invention |
| ADA/PDTA | 0.05/0.05 | 8 | 0.028 | 0.01 | Invention |
| ADA | 0.065 | 6 | 0.035 | 0.01 | Invention |
| ADA | 0.045 | 6 | 0.069 | 0.01 | Invention |
| ADA | 0.045 | 12 | 0.055 | 0.01 | Invention |
| LDDS | 0.34 | 6 | 0.282 | 0.48 | Comparison |
| EDDS | 0.25 | 6 | 0.881 | 0.39 | Comparison |
| EDDS | 0.20 | 6 | 1.128 | 0.01 | Comparison |
| EDDS/PDTA | 0.20/0.20 | 8 | 0.182 | 0.49 | Comparison |

As is evident from Table 1, the iron/EDTA complex does not achieve complete bleaching of the film material at low concentrations, even with distinctly extended bleaching times.

The iron/MIDA complex likewise does not achieve complete bleaching and moreover produces distinct bleaching fog. While the iron/PDTA and also the iron/ADA complex do indeed achieve complete bleaching at elevated concentrations, they also produce unacceptable bleaching fog. Surprisingly, no bleaching fog occurs at reduced concentration, while complete bleaching of the material is nevertheless achieved. At excessively low concentrations of the iron/PDTA and also of the iron/ADA complex, complete bleaching is not achieved even when bleaching times are extended. The concentration according to the invention of the iron/PDTA or iron/ADA complex or the mixture thereof in the tank solution is accordingly 0.045 to 0.25 mol/l.

An EDDS-based bleach bath does not exhibit adequate bleaching action even with extended bleaching times and elevated concentrations of the iron salt.

No differences were found between processing with a conditioning bath without a formalin releaser on the one hand and with a "pre-bleach" on the other.

Example 2

The conditioning bath used was of the following composition:

| | |
|---|---|
| Water | 800 ml |
| Ethylenediaminetetraacetic acid | 8.0 g |
| Sodium sulfite | 12.0 g |
| Thioglycerol in accordance with Table 2 make up to 1 liter with water | |
| pH value (adjust with KOH or sulfuric acid) | 6.15 |

The intention was to attempt to establish the lowest possible iron complex concentration by varying the content of thioglycerol, which acts as a bleaching accelerant. The results are shown in Table 2.

The bleaching time was 6 minutes in all the Examples.

TABLE 2

| Complexing agent | Iron complex concentration (mol/l) | Thioglycerol content per 1 of conditioning bath | Residual silver (g/m$^2$) | |
|---|---|---|---|---|
| EDTA | 0.34 | 0.4 ml | 0.034 | Comparison |
| EDTA | 0.20 | 0.4 ml | 1.153 | Comparison |
| EDTA | 0.20 | 10 ml | 1.036 | Comparison |
| PDTA | 0.34 | 0.4 ml | 0.026 | Comparison |
| PDTA | 0.34 | 20 ml | 0.295 | Comparison |
| ADA/PDTA | 0.05/0.20 | 4 ml | 0.029 | Invention |
| PDTA | 0.28 | 20 ml | 0.327 | Comparison |
| PDTA | 0.20 | 0.8 ml | 0.026 | Invention |
| PDTA | 0.20 | 4.0 ml | 0.030 | Invention |
| PDTA | 0.09 | 0.8 ml | 0.031 | Invention |
| ADA/PDTA | 0.06/0.03 | 20 ml | 0.032 | Invention |
| PDTA | 0.035 | 0.5 ml | 0.209 | Comparison |
| PDTA | 0.035 | 4 ml | 0.199 | Comparison |
| PDTA | 0.035 | 20 ml | 0.178 | Comparison |

As is evident from Table 2, bleaching action is surprisingly distinctly poorer at elevated Fe/PDTA concentrations and elevated thioglycerol concentrations than at low thioglycerol concentrations. Even high concentrations of thioglycerol cannot bring about a satisfactory improvement in bleaching action when Fe/PDTA concentrations are excessively low.

Further tests demonstrated that, within the concentration range according to the invention of 0.045 to 0.25 mol/l, when Fe/PDTA and/or Fe/ADA are used, it is also possible completely to dispense with thioglycerol and nevertheless achieve good bleaching action.

Example 3

Phosphates are frequently used in photographic baths, for example as buffers. The colour developer bath stated in the process sequence thus typically contains an inorganic phosphate. Phosphate ions may also enter the bleach bath by extraction from the film layers or from complexing agents used for water softening, such as for example sodium hexametaphosphate.

When this phosphate is entrained into the bleach bath, there is the risk that precipitates, for example iron phosphate, will form, causing breakdowns in the developing machine and damaging the reversal material. The effect of entrainment into the bleach bath was tested by adding $NaH_2PO_4$. The results shown in Table 3 were obtained.

TABLE 3

| Complexing agent | Iron complex concentration (mol/l) | Added quantity of $NaH_2PO_4$ (g/l) | Result | |
|---|---|---|---|---|
| PDTA | 0.34 | 5 | precipitates/ gelatinous mass | Comparison |
| PDTA | 0.34 | 0.5 | precipitates/ gelatinous mass | Comparison |
| PDTA | 0.28 | 5 | precipitates/ gelatinous mass | Comparison |
| PDTA | 0.28 | 0.5 | precipitates/ gelatinous mass | Comparison |
| ADA/ PDTA | 0.02/0.20 | 5 | clear solution | Invention |
| ADA | 0.15 | 5 | slight haze | Invention |
| PDTA | 0.25 | 5 | slight haze | Invention |
| PDTA | 0.20 | 5 | clear solution | Invention |
| PDTA | 0.20 | 0.5 | clear solution | Invention |
| PDTA | 0.045 | 5 | clear solution | Invention |
| PDTA | 0.045 | 0.5 | clear solution | Invention |

Table 3 shows that gelatinous precipitates form in bleach baths with the iron/PDTA complex if the concentration of the iron/PDTA complex is greater than 0.25 mol/l. Surprisingly, at lower concentrations, no precipitates are formed even at elevated phosphate concentrations and, at concentrations of up to 0.2 mol/l, not even any unproblematic slight haze is observable. Since relatively high phosphate concentrations may be established in the tank solution when the bleach bath is recirculated, precipitation becomes increasingly evident at elevated concentrations of the iron/PDTA complex. The Fe/ADA solutions which are effective according to the invention also exhibit less precipitation than the comparison solutions.

What is claimed is:

1. A color reversal process for processing silver halide materials comprising a bleaching step, wherein said bleaching step is performed using a solution which contains at least one iron complex of propylenediaminetetraacetic acid and the total concentration of the stated iron complex in the solution is at least 0.045 and at most 0.25 mol/l wherein prior to the bleaching step, the process comprises at least the steps:

first development, reversal step and color development.

2. The color reversal process according to claim 1, wherein the materials comprises a transparent support.

3. The color reversal process according to claim 1, wherein the process comprises a separate fixing step after the bleaching step.

4. The color reversal process according to claim 1, wherein prior to the bleaching step, the material passes through a conditioning bath.

5. The color reversal process according to claim 1, wherein the process equilibrium of the solution used for the bleaching step is maintained by apportioning a regenerator.

6. The color reversal process according to claim 5, wherein the process equilibrium of the solution used for the bleaching step is maintained by directly apportioning a preparation which comprises a concentrated solution.

7. The color reversal process according to claim 1, wherein the process equilibrium of the solution used for the bleaching step is maintained by apportioning a solution obtained from the bath overflow after rejuvenation.

8. The color reversal process according to claim 1, wherein the materials have a bleaching proportion of at least 65 mol-%.

9. The color reversal process according to claim 1, wherein the materials have a bleaching proportion of at least 80 mol-%.

10. The color reversal process according to claim 1, wherein the materials have a bleaching proportion of at least 90 mol-%.

11. The color reversal process according to claim 1, wherein the materials have a total quantity of silver of at least 6 $g/m^2$.

12. The color reversal process according to claim 1, wherein the materials have a total quantity of silver of at least 7.5 $g/m^2$.

13. The color reversal process according to claim 1, wherein per $m^2$ of the materials at least 3.9 g of silver must be bleached.

14. The color reversal process according to claim 1, wherein per $m^2$ of the materials at least 5.6 g of silver must be bleached.

15. The color reversal process according to claim 1, wherein per $m^2$ of the materials at least 6.3 g of silver must be bleached.

16. The color reversal process according to claim 1, wherein the solution is a bleach solution.

17. The color reversal process according to claim 1, wherein the solution contains substantially no further iron aminopolycarboxylic acid complex.

18. The color reversal process according to claim 1, wherein the solution contains no ammonium ions.

* * * * *